US009748656B2

(12) United States Patent
Parsche

(10) Patent No.: US 9,748,656 B2
(45) Date of Patent: Aug. 29, 2017

(54) BROADBAND PATCH ANTENNA AND ASSOCIATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 267 days.

(21) Appl. No.: 14/105,454

(22) Filed: Dec. 13, 2013

(65) Prior Publication Data

US 2015/0171520 A1 Jun. 18, 2015

(51) Int. Cl.
*H01Q 9/06* (2006.01)
*H01Q 9/04* (2006.01)

(52) U.S. Cl.
CPC ..... *H01Q 9/065* (2013.01); *H01Q 9/0414* (2013.01); *H01Q 9/0471* (2013.01); *Y10T 29/49016* (2015.01)

(58) Field of Classification Search
CPC ..... H01Q 9/065; H01Q 9/0471
USPC ..... 343/795
See application file for complete search history.

(56) References Cited

U.S. PATENT DOCUMENTS 2,480,153 A 8/1949 Masters
5,200,756 A * 4/1993 Feller ..... H01Q 1/3275 343/700 MS
5,442,366 A * 8/1995 Sanford ..... H01Q 9/0407 343/700 MS
5,502,451 A 3/1996 Rainville et al.
5,777,581 A 7/1998 Lilly et al.
5,943,016 A 8/1999 Snyder, Jr. et al.
5,959,588 A * 9/1999 Johannisson ..... H01Q 1/38 343/756

(Continued)

FOREIGN PATENT DOCUMENTS

EP 0649185 B1 12/2000
EP 1760833 3/2007

(Continued)

OTHER PUBLICATIONS

Bailey, A Stacked Patch Antenna Design with Strict Bandpass Filter Characteristics [Radiometer Applications], Antennas and Propagation Society International Symposium, IEEE Jun. 20-25, 2004, Abstract only.

(Continued)

*Primary Examiner* — Dameon E Levi
*Assistant Examiner* — Walter Davis
(74) *Attorney, Agent, or Firm* — Allen, Dyer, Doppelt + Gilchrist, P.A.

(57) ABSTRACT

The patch antenna includes an electrically conductive patch carried by a dielectric substrate and having a planar shape and a feed point defined therein. A feed conductor is coupled to the feed point of the electrically conductive patch, and a plurality of electrically conductive wings extend upwardly from a periphery of the electrically conductive patch. A method aspect may include adjusting at least one property (e.g. frequency) of the antenna by angling at least one of the plurality of electrically conductive wings outwardly from the electrically conductive patch.

19 Claims, 10 Drawing Sheets

(56) References Cited

U.S. PATENT DOCUMENTS

| | | | | |
|---|---|---|---|---|
| 6,023,244 | A * | 2/2000 | Snygg | H01Q 21/24 343/700 MS |
| 6,118,406 | A | 9/2000 | Josypenko | |
| 6,128,471 | A | 10/2000 | Quelch et al. | |
| 6,292,143 | B1 | 9/2001 | Romanofsky | |
| 6,342,857 | B1 | 1/2002 | Lane | |
| 6,501,427 | B1 | 12/2002 | Lilly et al. | |
| 6,606,061 | B2 | 8/2003 | Wong et al. | |
| 6,870,507 | B2 | 3/2005 | Anguera Pros et al. | |
| 7,079,078 | B2 * | 7/2006 | Yuanzhu | H01P 9/04 343/700 MS |
| 7,126,538 | B2 | 10/2006 | Sampo | |
| 7,151,491 | B2 | 12/2006 | Jacquinot | |
| 7,432,862 | B2 | 10/2008 | Heyde | |
| 7,495,627 | B2 | 2/2009 | Parsche | |
| 7,928,913 | B2 | 4/2011 | Kaneda et al. | |
| 2008/0122697 | A1 | 5/2008 | Mierke et al. | |
| 2010/0066627 | A1 * | 3/2010 | Parsche | H01Q 7/00 343/795 |
| 2010/0127939 | A1 * | 5/2010 | Yusa | H01Q 19/106 343/700 MS |
| 2011/0012788 | A1 * | 1/2011 | Rowell | H01Q 9/0414 343/700 MS |
| 2011/0050529 | A1 | 3/2011 | Popugaev et al. | |

FOREIGN PATENT DOCUMENTS

| | | | |
|---|---|---|---|
| WO | 0120712 | A2 | 3/2001 |
| WO | 2009030043 | A1 | 3/2009 |
| WO | 2009030045 | A1 | 3/2009 |

OTHER PUBLICATIONS

Meador et al., Low Dielectric Polyimide Aerogels as Substrates for Lightweight Patch Antennas, ACS Appl. Mater. Interfaces, 2012, Abstract only.

* cited by examiner

REPLACEMENT SHEET

10/10

BROADBAND PATCH ANTENNA AND ASSOCIATED METHODS

FIELD OF THE INVENTION

The present invention relates to the field of wireless communications, and, more particularly, to antennas and related methods.

BACKGROUND OF THE INVENTION

Newer designs and manufacturing techniques have driven electronic components to small dimensions and miniaturized many communication devices and systems. Unfortunately, antennas have not been reduced in size at a comparative level and often are one of the larger components used in a smaller communications device. It becomes increasingly important in communication applications to reduce not only antenna size, but also to design and manufacture a scalable size antenna having sufficient gain on the frequency needed. Accurate antenna tuning is important for small narrowband antennas.

In current, everyday communications devices, many different types of patch antennas, loaded whips, copper springs (coils and pancakes) and dipoles are used in a variety of different ways. These antennas, however, are sometimes large and impractical for a specific application. Antennas having diverging electric currents may be called dipoles, those having curling electric currents may be loops, and dipole-loop hybrids may comprise the helix and spiral. While dipole antennas can be thin linear or "1 dimensional" in shape, loop antennas are at least 2 dimensional. Loop antennas can be a good fit for planar requirements.

Antennas can of course assume many geometric shapes. The Euclidian geometries are sometimes preferential for antennas as they convey optimizations known through the ages. For instance, line shaped dipoles may have the shortest distance between two points, and circular loop antennas may have the most enclosed area for the least circumference. So, both line and circle shapes may minimize antenna conductor length to increase radiation efficiency. Yet line and circle shaped antennas may not meet all needs, such as operation at small physical size relative wavelength and a self loading antenna structure may be needed, such as a helix or spiral antenna.

Simple flat or patch antennas can be manufactured as printed circuit boards (PCBs) at low costs and have been developed as antennas for the mobile communication field. The microstrip patch antenna is configured, for example, by disposing a patch conductor cut to a predetermined size over a conductive "ground" plate through a dielectric material. An elegant compound design results: one or more patch edges may radiate as slot antennas, a transmission line impedance matching transformer is obtained, unidirection radiation can be provided, and patch sizing allows synthesis of radiation pattern shapes. The patch may even be excited for linear, circular, and dual polarizations. Patch efficiency may exceed 90%. For comparision, parabolic reflectors may operate at only 50 to 80 percent efficiency, due to factors of feed spillover, non uniform aperture illumination, and surface tolerances. In fact, few or no antennas exceed patch antennas in realized gain for area. Patch arrays may exceed $G_r > 10 \log_{10} [(0.9)4\pi a/\lambda^2]$, where Gr is realized gain in dBi, a is the area of the patches in square meters, and $\lambda$ is the free space wavelength in meters.

However, microstrip patch antennas typically are efficient only in a narrow frequency band. They are poorly shaped for wave expansion, such that microstrip antenna bandwidth is proportional to antenna thickness. Bandwidth can even approach zero with vanishing thickness (for example, see Munson, page 7-8 "Antenna Engineering Handbook", 2nd ed., H. Jasik ed.). Limitations of narrow instantaneous radiation bandwidth are potentiated by any variation in PWB substrate dielectric constant; tuning drift may cause the high gain may be unavailable on the frequency needed. This can be problematic when high dielectric constant substrates are used: the miniaturized patch has less fixed tuned bandwidth to mitigate tuning errors, yet high dielectric constant materials typically have wider dielectric constant variations. The typical microstrip patch antenna may not support the whole 1500-1700 MHz mobile satcom band, for example. It also includes sensitive tuning tolerances and production frequency trimming is upwards only (e.g. via patch ablation). Patch resonant frequency is inversely proportional to the square root of substrate dielectric constant ($f \sim 1/\sqrt{\in_r}$).

U.S. Pat. No. 6,501,427 to Lilly et al. entitled "Tunable Patch Antenna" is directed to a patch antenna including a segmented patch and reed like MEMS switches on a substrate. Segments of the structure can be switched to reconfigure the antenna, providing a broad tunable bandwidth. Instantaneous bandwidth may be unaffected however.

U.S. Pat. No. 7,126,538 to Sampo entitled "Microstrip Antenna" is directed to a microstrip antenna with a dielectric member disposed on a grounded conductive plate. A patch antenna element is disposed on the dielectric member.

U.S. Pat. No. 7,495,627 to Parsche entitled "Broadband Planar Dipole Antenna Structure And Associated Methods" describes a planar dipole-circular microstrip patch antenna with increased instantaneous gain bandwidth by polynomial tuning.

U.S. Pat. No. 7,432,862 to Heyde is directed to a broadband patch antenna including a planar metallic patch sheet that is provided with right-angled edges. U.S. Pat. No. 6,606,061 to Wong et al. is directed to a broadband circularly polarized patch antenna including an L-shaped ground plane consisting of a vertical ground plane and a horizontal ground plane, a radiating metal patch, a probe feed placed coplanarly with the radiating metal patch and connected to the radiating metal patch through the vertical ground plane, and a substrate between the radiating metal patch and the horizontal ground plane.

There may be a desire for a planar patch antenna that may be flexible and/or scalable as to frequency, and provide adequate gain and wide bandwidth.

SUMMARY OF THE INVENTION

In view of the foregoing background, it is therefore an object of the present invention to provide a broadband and/or tunable patch antenna.

This and other objects, features, and advantages in accordance with the present invention are provided by a patch antenna including a substrate, an electrically conductive patch carried by the substrate and having a planar shape and a feed point defined therein, a feed conductor coupled to the feed point of the electrically conductive patch, and a plurality of electrically conductive wings extending upwardly from a periphery of the electrically conductive patch.

The periphery of the electrically conductive patch may have a polygonal shape defining a plurality of linear segments and associated vertices. The plurality of electrically conductive wings may comprise a respective electrically conductive wing extending upwardly from each linear segment. Each of the plurality of electrically conductive wings may comprise at least one triangular shaped portion. Each of the plurality of electrically conductive wings may comprise a triangular shaped portion with a base extending along a respective linear segment, and an apex opposite the base.

Each of the plurality of electrically conductive wings may comprise first and second right angle triangular shaped portions each with a leg extending upward from a respective vertex and a hypotenuse extending to a common medial position along a respective linear segment. The polygonal shape may comprise a rectangular shape. At least one of the plurality of electrically conductive wings may be angled outwardly from the electrically conductive patch. Also, a ground plane and a dielectric layer may be between the substrate and the electrically conductive patch.

A method aspect is directed to a method for making a patch antenna including forming an electrically conductive patch adjacent a substrate and having a planar shape and a feed point defined therein, coupling a feed conductor to the feed point of the electrically conductive patch, and forming a plurality of electrically conductive wings extending upwardly from a periphery of the electrically conductive patch.

The periphery of the electrically conductive base may have a polygonal shape defining a plurality of linear seyments and associated vertices, and wherein forming the plurality of electrically conductive wings comprises forming a respective electrically conductive wing extending upwardly from each linear segment. Forming the plurality of electrically conductive wings may comprise farming each to have at least one triangular shaped portion. The method may include adjusting at least one property of the antenna by angling at least one of the plurality of electrically conductive wings outwardly from the electrically conductive patch.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
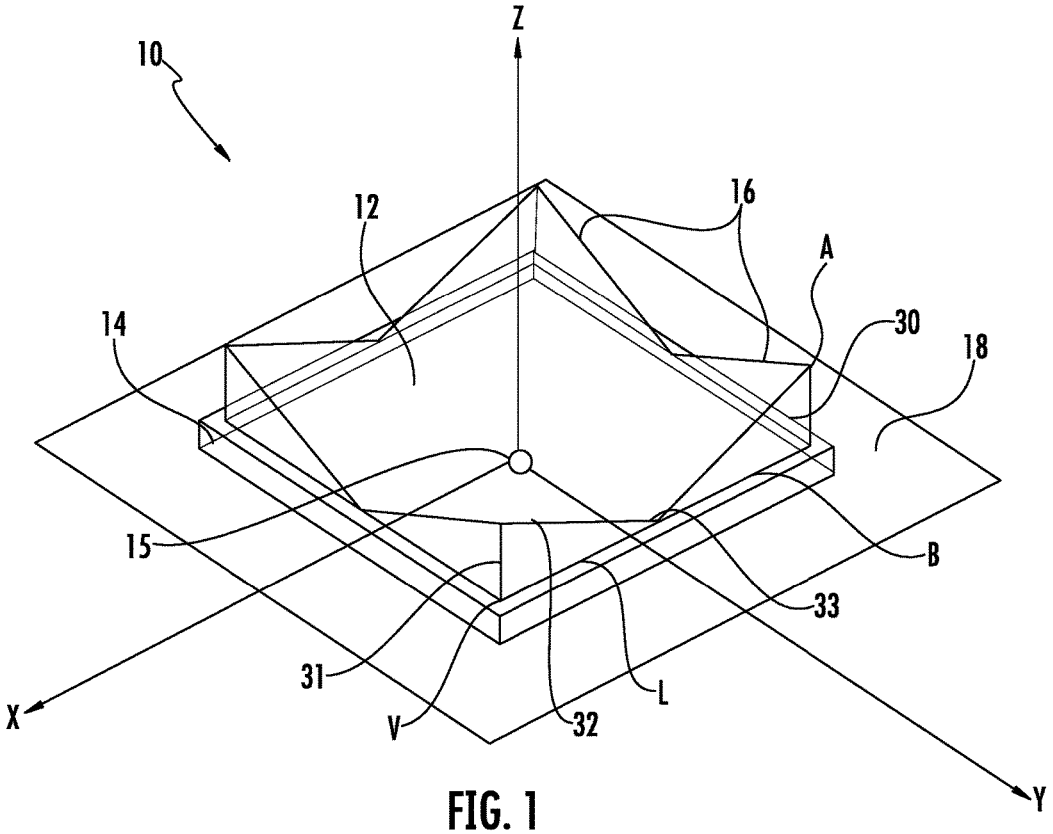
FIG. 1 is a perspective view of an embodiment of a patch antenna in accordance with the present invention.
Figure 2:
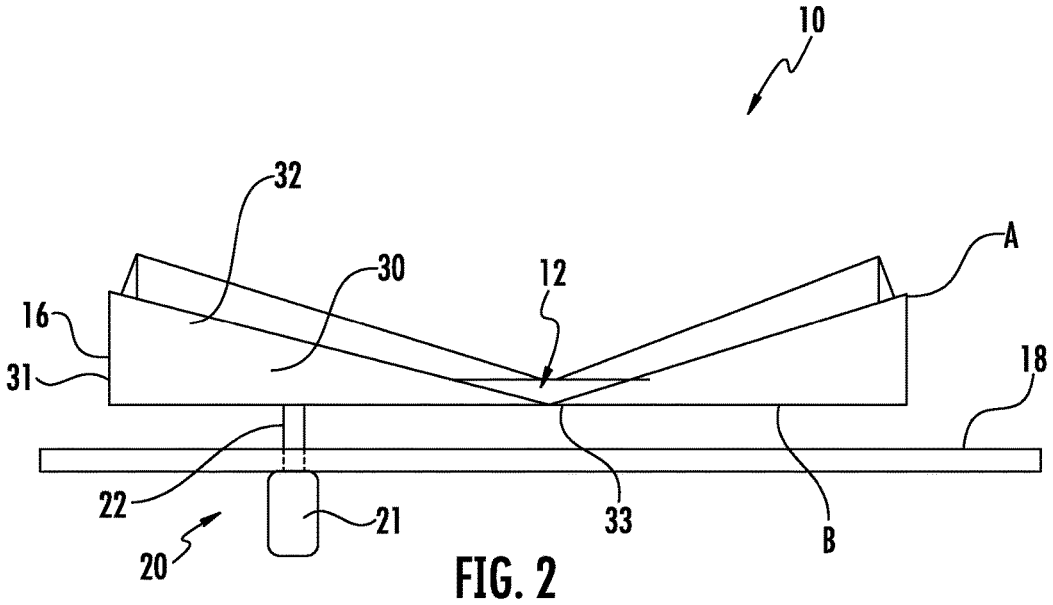
FIG. 2 is a side view of the patch antenna of FIG. 1.

Referring initially to FIGS. 1 and 2, an embodiment of a patch antenna 10 in accordance with features of the present invention will be described. The patch antenna 10 includes an electrically conductive patch 12, e.g. carried by a dielectric substrate 14, and having a planar shape and a feed point 15 defined therein. A feed conductor 20 is coupled to the feed point 15 of the electrically conductive patch 12. The dielectric substrate 14 may one or more materials such as Teflon, a magnetic substrate such as ferrite, a plastic foam, honeycomb structure, or even air.

Also, a ground plane 18 may be adjacent the dielectric substrate 14 and the electrically conductive patch 12. As illustrated in FIG. 2, such feed connector 20 may be a coaxial connector including and outer conductor 21 coupled to the ground plane 18, and an inner conductor 22 coupled to the feed point 15.

A plurality of electrically conductive wings 16 extend upwardly from a periphery of the electrically conductive patch 12. Such electrically conductive wings 16 may be characterized as batwings. The edges of the electrically conductive patch 12, including the electrically conductive wings 16 may electrically constitute batwing slot dipoles.

The periphery of the electrically conductive patch 12 may have a polygonal shape, e.g. a rectangular or square shape, defining a plurality of linear segments L and associated vertices V. The plurality of electrically conductive wings 16 may comprise a respective electrically conductive wing 16 extending upwardly from each linear segment L. Each of the plurality of electrically conductive wings 16 may comprise at least one triangular shaped portion 30. Each of the plurality of electrically conductive wings 16 may comprise a triangular shaped portion 30 with a base B extending along a respective linear segment L, and an apex A opposite the base. For broadside radiation the perimeter of a square patch 12 may be between about 1.5 and 1.95 guide wavelengths in perimeter at resonance, e.g. $1.52\lambda_{air}\sqrt{\in_r}<p<2\lambda_{air}\sqrt{\in_r}$, where p is the perimeter around the square patch element, $\lambda_{air}$ is the wavelengths in air, and $\in_r$ is the relative permittivity of the dielectric substrate. Of course, the electrically conductive patch 12 may be other sizes and shapes such as rectangular or circular. The tradeoffs between broadside firing square and circular patches include: square patches are somewhat larger in size than the circular patches for the same resonant frequency; square patches provide about 1 dB more gain than the circle shaped patches; square patches provide more total instantaneous bandwidth than the circle; circle patches give more instantaneous bandwidth per area than the square.

Each of the plurality of electrically conductive wings 16 may comprise first and second right angle triangular shaped portions 30 each with a leg 31 extending upward from a respective vertex V and a hypotenuse 32 extending to a common medial position 33 along a respective linear segment L.

Figure 3:
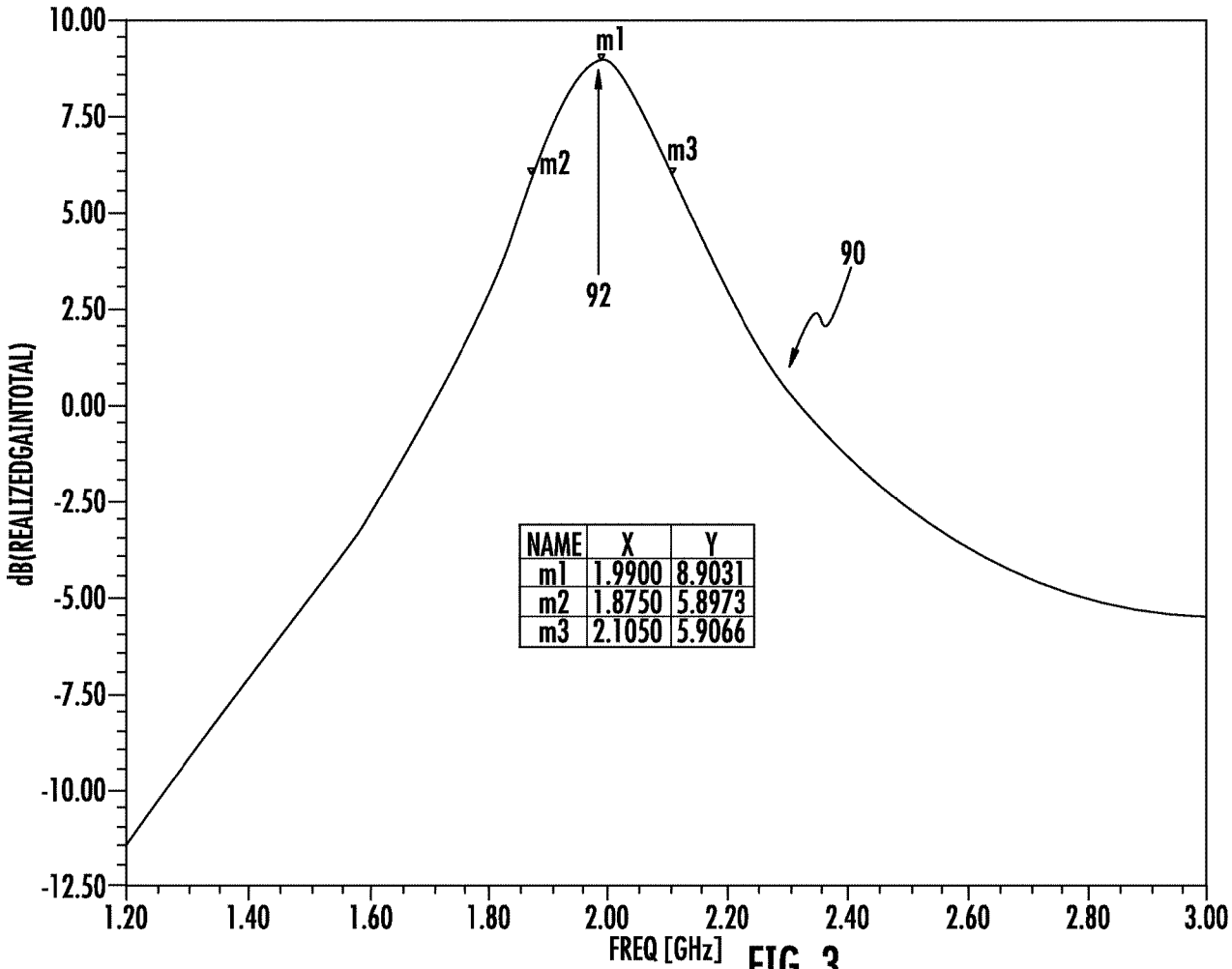
FIG. 3 (PRIOR ART)
FIG. 3 is a graph of frequency and gain for a patch antenna according to the prior art.
Figure 4:
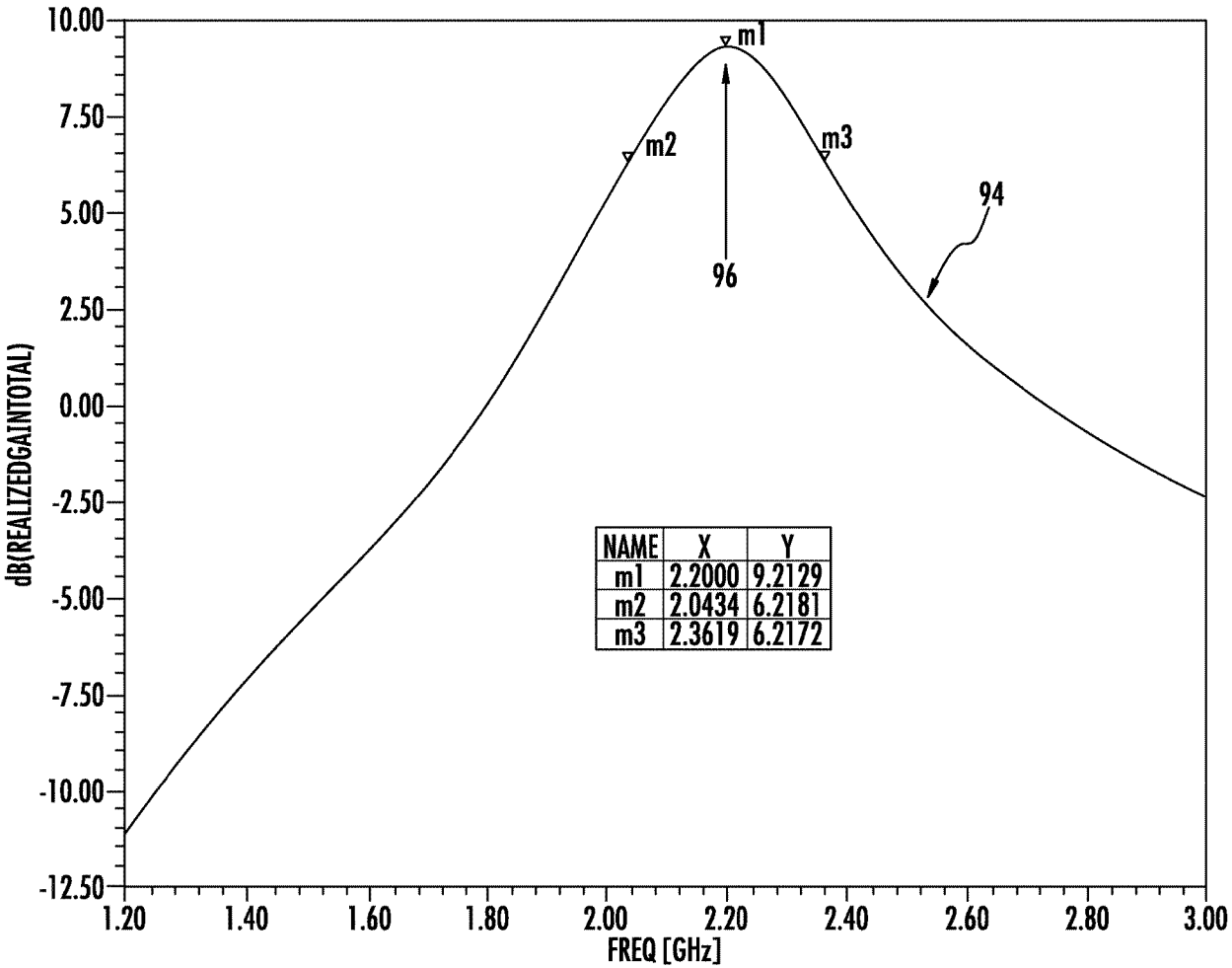
FIG. 4 is a graph of frequency and gain for the patch antenna of FIG. 1.

Gain responses with and without the plurality of electrically conductive wings 16 will now be described. FIG. 3, trace 90 is the response of the square patch of FIG. 1 including the electrically conductive wings 16, which at that time were standing straight up from (and therefore perpendicular to the plane of) the patch antenna 10. FIG. 4, trace 92 is the same antenna response without the electrically conductive wings 16. As can be seen, the wings caused a 9.5% downward shift of the peak gain frequencies 92, 96, providing a useful approach for patch antenna size reduction and tuning. There was no change to the radiation pattern shape with or without the wings, which was a single petal rose broadside to the patch plane.

Figure 5:
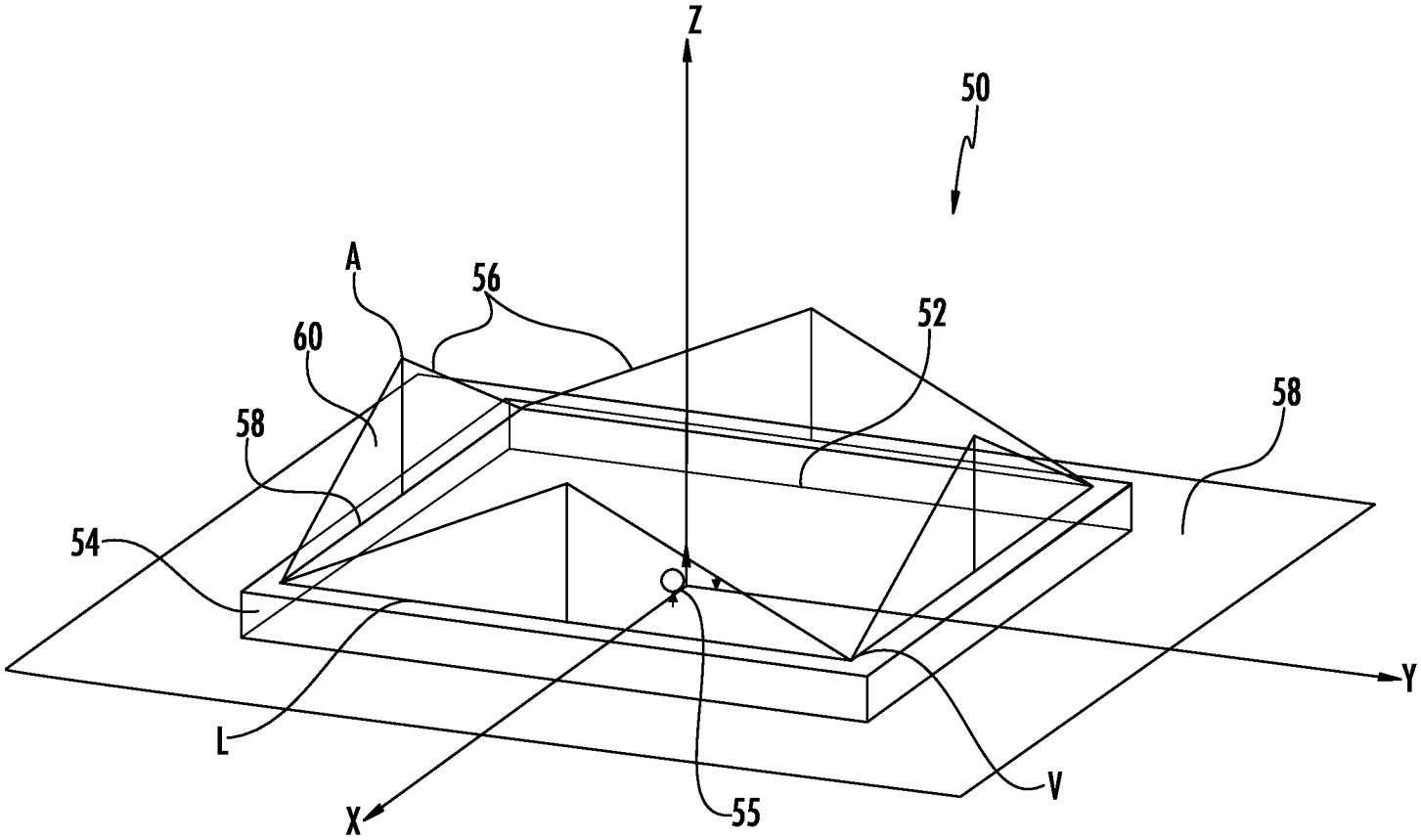
FIG. 5 is a perspective view of another embodiment of a patch antenna in accordance with the present invention.
Figure 6A:
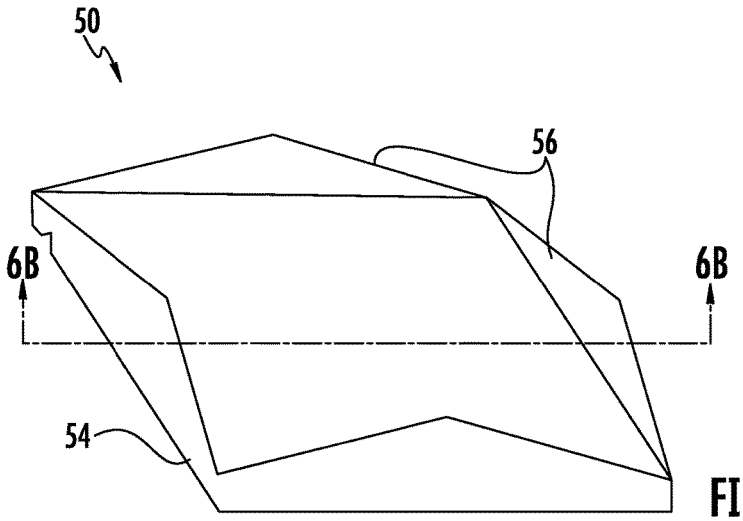
FIGS. 6A and 6B are views of the patch antenna of FIG. 5 and illustrating a tuning feature.
Figure 6B:
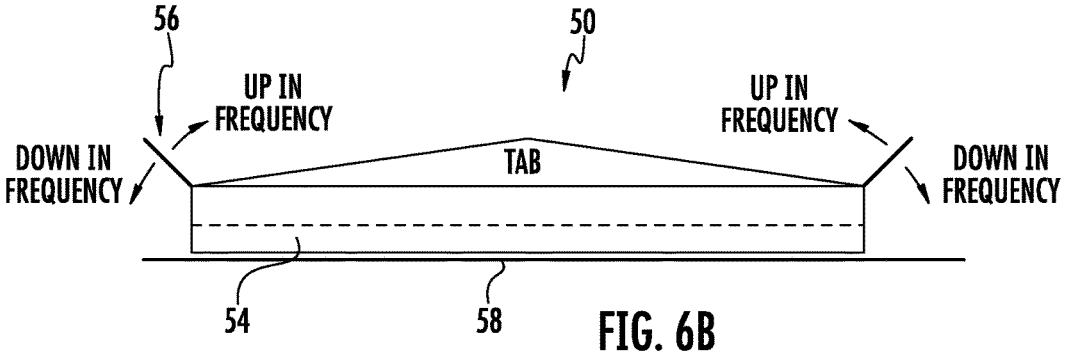

Referring now to FIGS. 5, 6A and 6B, another embodiment of a patch antenna 50 in accordance with features of the present invention will be described. The patch antenna 50 includes an electrically conductive patch 52, e.g. carried by a dielectric substrate 54, and having a planar shape and a feed point 55 defined therein. A feed conductor may be coupled to the feed point 55 of the electrically conductive patch 52. A plurality of electrically conductive wings 56 extend upwardly from a periphery of the electrically conductive patch 52. Such electrically conductive wings 56 may be characterized as bowtie wings.

The periphery of the electrically conductive patch 52 may have a polygonal shape, e.g. a rectangular or square shape, or a trapezoidal shape as shown, defining a plurality of linear segments L and associated vertices V. The plurality of electrically conductive wings 56 may comprise a respective electrically conductive wing 56 extending upwardly from each linear segment L. Each of the plurality of electrically conductive wings 56 may comprise at least one triangular shaped portion 60. Each of the plurality of electrically conductive wings 56 may comprise a triangular shaped portion 60 with a base B extending along a respective linear segment L, and an apex A opposite the base. At least one of the plurality of electrically conductive wings 56 may be angled outwardly from the electrically conductive patch 52.

Figure 6C:
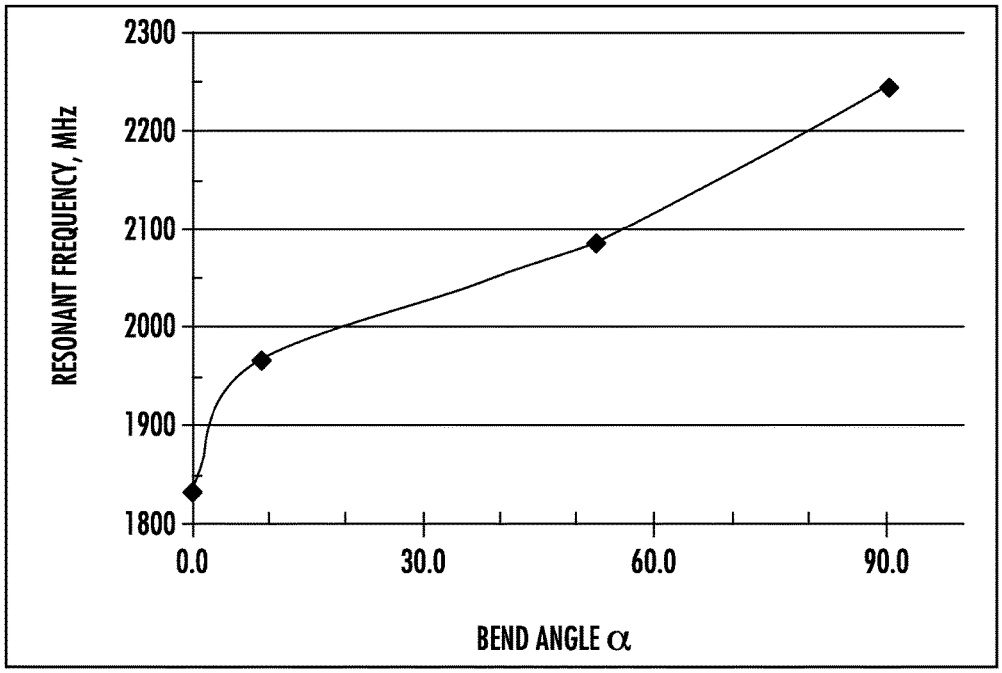
FIG. 6C is a graph of frequency and bend angle for the patch antenna of FIG. 5.

The bend angle $\alpha$ of the electrically conductive wings 56 may be changed to adjust the frequency of each edge of the electrically conductive patch 52, e.g. as illustrated in the graph of FIG. 6C. Bend angle $\alpha$ is 0 degrees when the electrically conductive wings 56 are flat against the printed circuit board, and 90 degrees when the electrically conductive wings 56 are perpendicular. The frequency may be increased by bending the respective electrically conductive wing 56 upwardly away from the patch plane, or decreased by bending such electrically conductive wing 56 downwardly towards the patch plane. For example, a frequency adjustment range of +/−12% may be obtained via the bending angle of the electrically conductive wings 56.

As the electrically conductive wings 56 may cause a downward frequency shift, even when the wings are straight up (bend angle $\alpha$ 90°), a method of using the electrically conductive wings 16 is to downsize the electrically conductive patch 12 prior to receiving electrically conductive wings 16. So, the electrically conductive patch 12 may be tuned upwards by patch size reduction prior to receiving the electrically conductive wings 16. One way to do this is by patch ablation. Of course, the electrically conductive patch 12 and electrically conductive wings 16 may alternatively be designed together or even fabricated together as a single part.

The electrically conductive wings 56 may be formed or implemented in many ways. One method to implement the electrically conductive wings 56 is to manufacture the electrically conductive wings 56 and the patch 52 separately. In this case the electrically conductive wings may be stamped sheet metal, the patch a printed wiring board feature formed by milling or etching, and the wings subsequently joined to the patch by soldering. Another way to provide the electrically conductive wings 56 is to form the electrically conductive wings 56 and the patch 52 at the same time, e.g. from a common sheet metal stamping.

Figure 7:
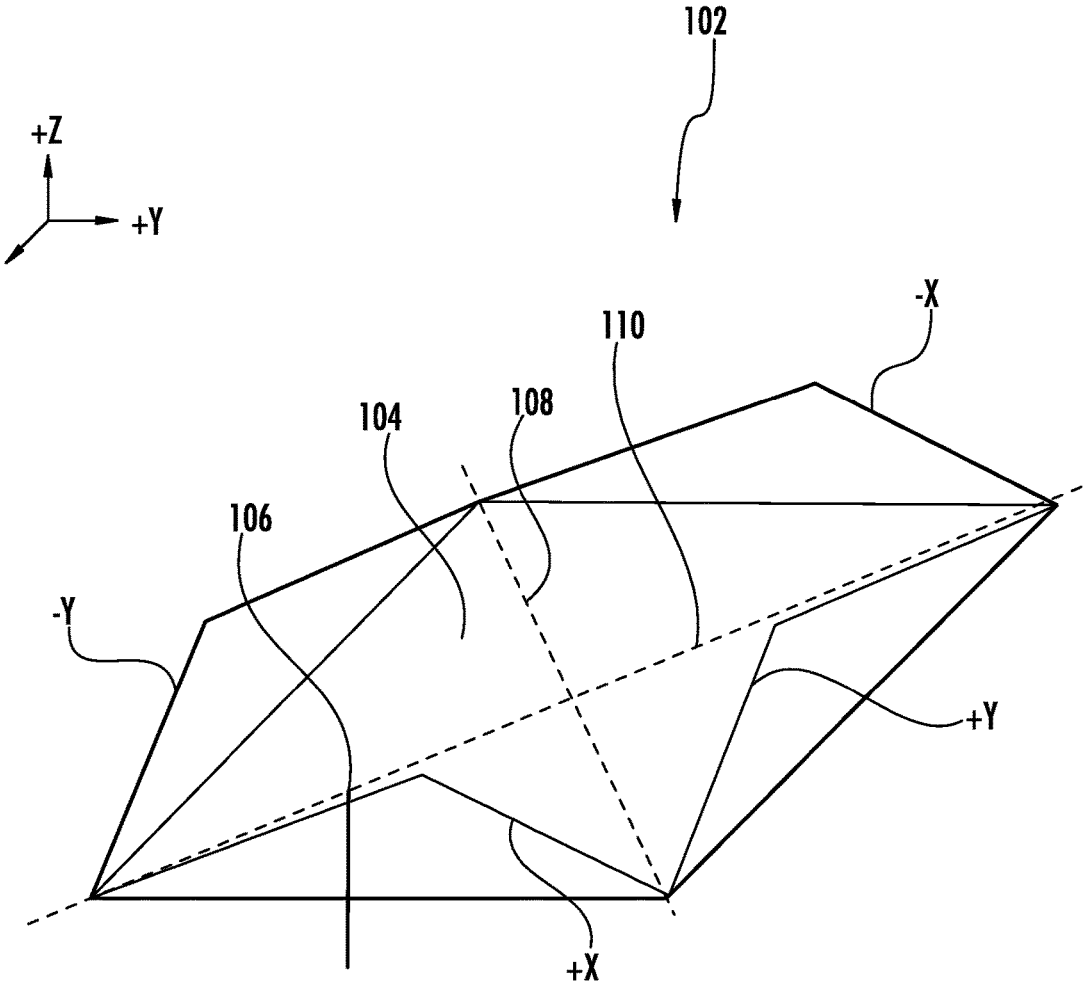
FIG. 7 is a schematic diagram of an embodiment of a square patch antenna in accordance with the present invention.

A method of the invention is to synthesize circular polarized radiation using the electrically conductive wings. Illustrating this method, the FIG. 7 diagram 102 depicts a square microstrip patch 104 antenna with four adjustable electrically conductive wings, denoted by position as +X, +Y, −X, −Y. Each of the four adjustable electrically conductive wings +X, +Y, −X, −Y permits independent adjustment of resonance frequency for that radiating patch edge. Patch 104 may be suspended over a ground plane using a dielectric layer, but these features are not shown for clarity. Electrical feed pin 106 may excite the patch at a point along either of the imaginary diagonals depicted as a dashed lines 108, 110. Locating the feed along a diagonal ensures that the RF power divides four ways to equally excite all radiating edges. Other feed arrangements may be used though such as microstrip trace touching the patch corner or parasitic coupling.

Patch 104 is made square (all edges equal length of course) and the patch edges may be at fundamental resonance between 0.4 to 0.5 wavelengths long electrically, e.g. $0.4c/f\sqrt{\in_r}<L<0.4c/f\sqrt{\in_r}$ meters, L is the edge length in meters, c is the speed of light in meters/second, f is the operating frequency in Hertz, and $\in_r$ is the real part of the substrate relative permittivity, which is a dimensionless number. This patch size provides broadside radiation normal to the patch plane. For illustration, all of the adjustable electrically conductive wings initially have the same bend angle $\alpha$, e.g. 45 degrees. Now, to synthesize right hand circular polarization in the +Z direction: 1) the +X and −X adjustable electrically conductive wings are adjusted downward towards the patch plane slightly, while 2) the +Y and −Y adjustable electrically conductive wings are adjusted upwards away from the patch plane slightly. The effect of these wing adjustments is to cause the +X, −X radiating edges to be resonant slightly lower than the operating frequency, and the +Y, −Y edges to be resonant slightly higher than the operating frequency. Radiation from the +X, −X radiating edges will now lag somewhat in phase and radiation from the +Y, −Y radiating edges will lead somewhat in phase. Quantitatively, for perfectly circular right hand circular polarization the wings are adjusted such that the +X, −X radiating edges are 45 degrees lagging in phase, and the +Y, −Y radiating edges are 45 degrees leading in phase. The resulting 90 degree phase difference between the orthogonal radiating edges is sufficient to cause the circular polarization wave rotation. Differences between +X, −X edge resonate frequency and +Y, −Y resonate frequency to accomplish this may be small, between about 0.5 to 4 percent.

Polarization bandwidth from this method is narrow but the VSWR bandwidth is increased, about double. The resulting circular polarization VSWR response will have two minima on either side of the operating frequency, and a center rise, like a $4^{th}$ order Chebyschev filter response. Without the circular polarization synthesis the VSWR response is quadratic with only one minima. This method can supply any rotational polarization, circular or elliptical. elliptical polarization may be obtained by moving the feed point off the diagonals to unequally power the radiating edges. It is understood here that when rotational polarization is recited, both circular and elliptical polarization are being referred to here.

Special considerations apply to the use of circular shaped microstrip patch elements used for circular polarization. Unlike the square and rectangular patch, circular polarization from circular patch elements by unequal edge resonances may not be practical: separate, uncoupled radiating edges are not present on a circle. While linearly polarized circular patch antennas have standing wave current distributions, circularly polarized patch antennas have traveling wave current distributions. So, the circular shaped circularly polarized patch may have current maxima (lumps of current) rotating around the patch periphery at a rate of $\omega=2\pi f$ rotations/second. Typically, the number of current lumps that form is two, regardless of circular patch size.

Figure 8:
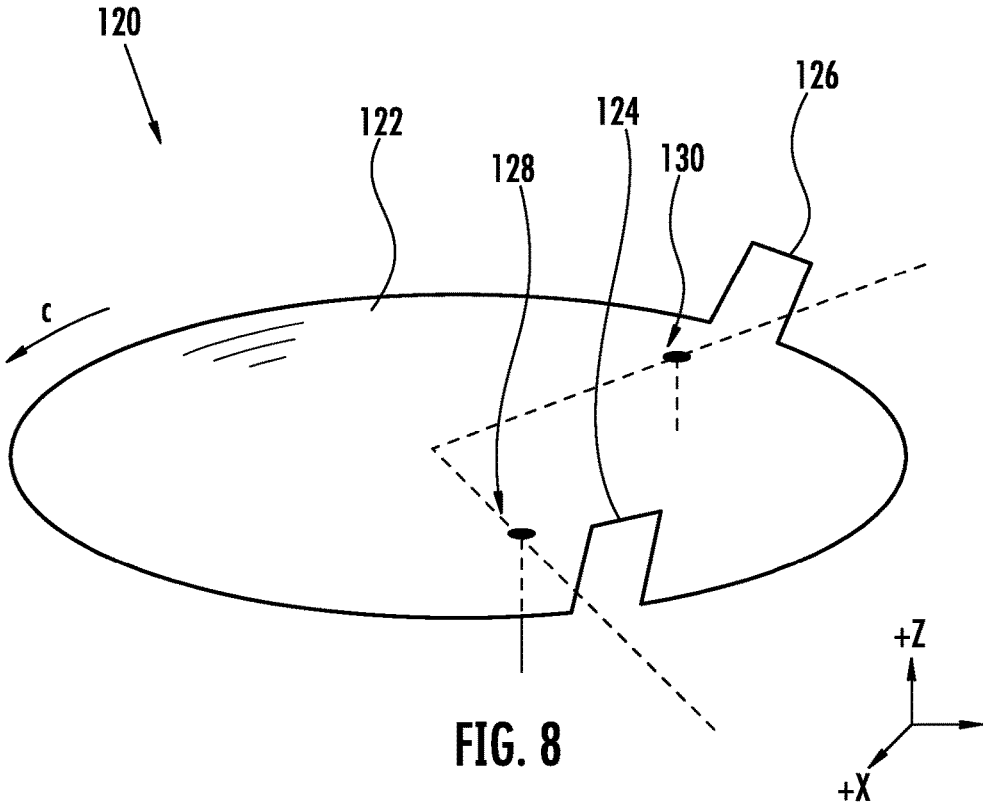
FIG. 8 is a schematic diagram of an embodiment of a circular patch antenna in accordance with the present invention.
Figure 9:
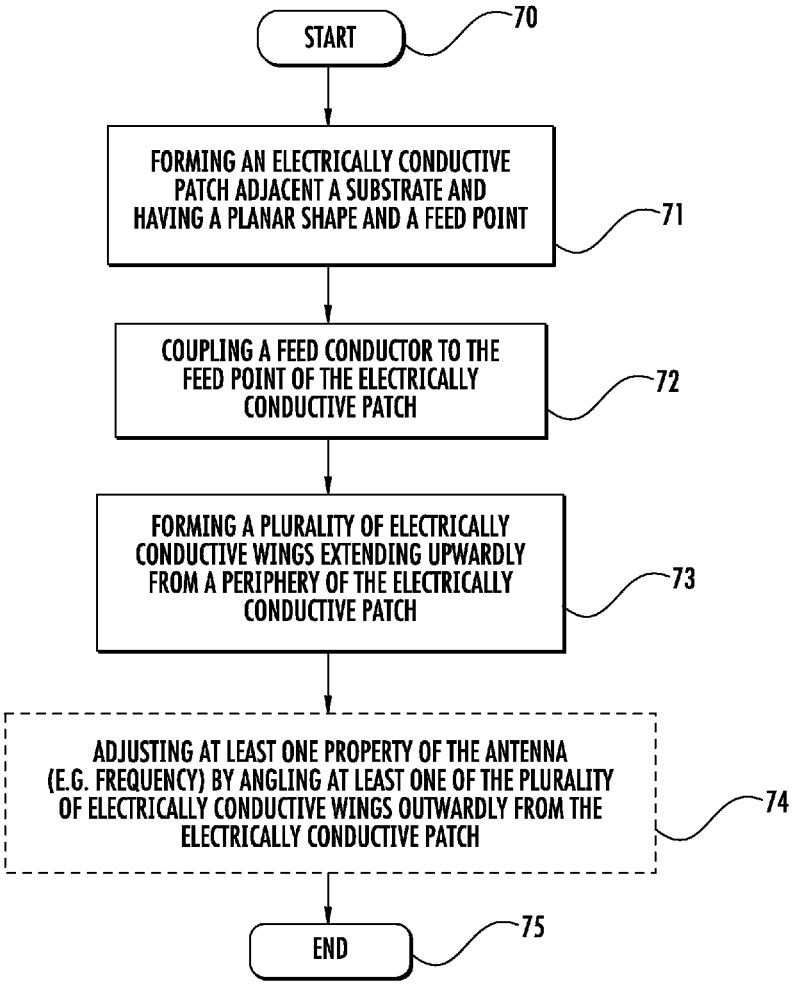
FIG. 9 is a flowchart illustrating an embodiment of a method in accordance with features of the present invention.

Referring to FIG. 8 then, a practical circularly polarized circular element patch antenna 122 utilizing conductive wings 124, 126 is depicted. The FIG. 8 example depicts a method of the invention for utilizing conductive wings on circularly polarized circular element patch antennas. In the FIG. 8 example the patch circumference C is about 1.76 wavelengths in dielectric , e.g. $C=1.76\lambda_g=1.76\ \lambda_{air}/\sqrt{\in_r}=1.76c/f\sqrt{\in_r}$. A ground plane may be present but not depicted. Here two feed pins 128, 130 are utilized, clocked around the patch at 12:00 O'clock and 3 O'clock. Feed pins 128, 130 are driven at equal power amplitude but at a 90 degrees phase difference, e.g. $1\angle 0°$ and $1\angle 90°$. This quadrature (0, 90 degree) phase excitation is sufficient to cause circular polarization from the circular patch by inducing a traveling wave current there.

Conductive wings 124, 126 are present and similarly "clocked" around the periphery of the patch with the drive pins, e.g. they are each in planes with the patch 122 center and the drive pins 128, 130. A single conductive wing (not used or depicted) would disrupt circularly polarized circular patch operation due to perturbation of the surface waves that attach and rotating about the patch periphery; reflections from a single wing alone would result in a countersense traveling wave current that would buck the radiation from the desired sense traveling wave current. However, in the FIG. 8 geometry two conductive wings 124, 126 are specially deployed 90 degrees apart to prevent this limitation. Two wings so disposed 90° apart have a hybrid relationship to one another so reflections from one will not reflect from the other.

Equal surface wave perturbations do occur from each conductive wing 124, 126 but the reflective perturbations cancel one another. For best results, the conductive wings 124, 126 of FIG. 8 are therefore made equal in size, shape, and bend angle $\alpha$. The FIG. 8 embodiment advantageously may allow frequency trimming of circular patch antennas, e.g. to mitigate dielectric variations in unit production. The method includes adjusting the two electrically conductive wings 124, 126 an identical amount when antenna frequency is adjusted.

Referring additionally to the flowchart of FIG. 8, a method aspect is directed to a method for making a patch antenna 10. The method begins (block 70) and includes forming an electrically conductive patch 12 adjacent a dielectric substrate 14 and having a planar shape and a feed point 15 defined therein (block 71). At block 72, the method includes coupling a feed conductor 20 to the feed point 15 of the electrically conductive patch 12. Further, the method includes forming a plurality of electrically conductive wings 16 extending upwardly from a periphery of the electrically conductive patch 12 (block 73).

The periphery of the electrically conductive base 12 may have a polygonal shape defining a plurality of linear segments L and associated vertices V, and wherein forming the plurality of electrically conductive wings 16 (at block 73) comprises forming a respective electrically conductive wing 16 extending upwardly from each linear segment L. Forming the plurality of electrically conductive wings 16 may comprise forming each to have at least one triangular shaped portion 30.

The method (at block 74) may additionally include adjusting at least one property of the patch antenna 50 by angling at least one of the plurality of electrically conductive wings 56 outwardly from the electrically conductive patch 52 before ending at block 75.

Accordingly, a broadband patch antenna is described above including the use of batwing and bowtie tabs that form broadband dipoles. Tuning and production trimming are included, and circular polarization may be provided. The patch antenna type is ubiquitous for GPS and personal communications, e.g. LTE mobile data. The planar patch antenna is flexible and scalable as to frequency, and provides adequate gain and wide bandwidth, for many modes and sizes of patch antennas.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A patch antenna comprising:

a substrate;

an electrically conductive patch carried by said substrate and having a planar shape and a feed point defined therein;

a feed conductor coupled to the feed point of said electrically conductive patch; and a plurality of electrically conductive wings directly electrically connected to a periphery of said electrically conductive patch and extending upwardly therefrom and away from said substrate, each of said plurality of electrically conductive wings having a triangular shape and configured to bend along the periphery of said electrically conductive patch to adjust a frequency of a respective edge of the electrically conductive patch.

2. The patch antenna according to claim 1 wherein the periphery of said electrically conductive patch has a polygonal shape defining a plurality of linear segments and associated vertices.

3. The patch antenna according to claim 2 wherein said plurality of electrically conductive wings comprises a respective electrically conductive wing extending upwardly from each linear segment.

4. The patch antenna according to claim 2 wherein each of said plurality of electrically conductive wings comprises a base extending along a respective linear segment, and an apex opposite the base.

5. The patch antenna according to claim 2 wherein each of said plurality of electrically conductive wings comprises first and second right angle triangular shaped portions each with a leg extending upward from a respective vertex and a hypotenuse extending to a common medial position along a respective linear segment.

6. The patch antenna according to claim 2 wherein the polygonal shape comprises a rectangular shape.

7. The patch antenna according to claim 1 wherein at least one of said plurality of electrically conductive wings is angled outwardly from said electrically conductive patch.

8. The patch antenna according to claim 1 further comprising a ground plane and a dielectric layer between said substrate and said electrically conductive patch.

9. A broadband patch antenna comprising:

a substrate;

a ground plane carried by said substrate;

a dielectric layer carried by said ground plane;

an electrically conductive patch carried by said dielectric layer and having a planar shape and a feed point defined therein, said electrically conductive patch having a polygonal shape defining a plurality of linear segments and associated vertices;

a feed conductor coupled to the feed point of said electrically conductive patch; and a plurality of electrically conductive wings directly electrically connected to a periphery of said electrically conductive patch and each extending upwardly from a respective linear segment and away from said substrate, each of said plurality of electrically conductive wings having a triangular shape and configured to bend along the respective linear segment to adjust a frequency of a respective edge of the electrically conductive patch.

10. The broadband patch antenna according to claim 9 wherein each of said plurality of electrically conductive wings comprises a base extending along the respective linear segment, and an apex opposite the base.

11. The broadband patch antenna according to claim 9 wherein each of said plurality of electrically conductive wings comprises first and second right angle triangular shaped portions each with a leg extending upward from a respective vertex and a hypotenuse extending to a common medial position along the respective linear segment.

12. The broadband patch antenna according to claim 9 wherein at least one of said plurality of electrically conductive wings is angled outwardly from said electrically conductive patch.

13. The broadband patch antenna according to claim 9 wherein the polygonal shape comprises at least one of a square shape and a rectangular shape.

14. A method for making a patch antenna comprising:

forming an electrically conductive patch adjacent a substrate and having a planar shape and a feed point defined therein;

coupling a feed conductor to the feed point of the electrically conductive patch; and forming a plurality of electrically conductive wings directly electrically connected to a periphery of said electrically conductive patch and extending upwardly therefrom and away from the substrate, each of the plurality of electrically conductive wings having a triangular shape and configured to bend along the periphery of the electrically conductive patch to adjust a frequency of a respective edge of the electrically conductive patch.

15. The method according to claim 14 wherein the periphery of the electrically conductive base has a polygonal shape defining a plurality of linear segments and associated vertices; and wherein forming the plurality of electrically conductive wings comprises forming a respective electrically conductive wing extending upwardly from each linear segment.

16. The method according to claim 15 further comprising adjusting at least one property of the antenna by angling at least one of the plurality of electrically conductive wings outwardly from the electrically conductive patch.

17. The method according to claim 15 further comprising forming a ground plane and a dielectric layer between the substrate and the electrically conductive patch.

18. The method according to claim 14 further comprising differently orienting the electrically conductive wings to enable rotational polarization radiation.

19. The method according to claim 18 wherein the periphery of the electrically conductive patch defines radiating edges having unequal resonant frequencies.

* * * * *